US010028579B2

(12) United States Patent
Kantor

(10) Patent No.: US 10,028,579 B2
(45) Date of Patent: Jul. 24, 2018

(54) COLLATOR

(71) Applicant: Brant Kantor, Los Angeles, CA (US)

(72) Inventor: Brant Kantor, Los Angeles, CA (US)

( * ) Notice: Subject to any disclaimer, the term of this patent is extended or adjusted under 35 U.S.C. 154(b) by 0 days.

(21) Appl. No.: 15/617,534

(22) Filed: Jun. 8, 2017

(65) Prior Publication Data

US 2017/0265642 A1 Sep. 21, 2017

(51) Int. Cl.
*A47B 63/00* (2006.01)
*A47B 43/00* (2006.01)

(52) U.S. Cl.
CPC ..... *A47B 63/00* (2013.01); *A47B 43/00* (2013.01)

(58) Field of Classification Search
CPC ..... A47B 63/00; A47B 63/06; A47B 65/00; A47B 43/00; A47B 43/04; B42F 17/08; B42F 17/10; B42F 17/18; B65H 31/24
USPC ..... 135/131, 145
See application file for complete search history.

(56) References Cited

U.S. PATENT DOCUMENTS 1,682,667 A 8/1928 Eifel
2,470,337 A * 5/1949 Campbell ..... E04F 10/02 135/131
2,961,101 A * 11/1960 Hutton ..... A47F 5/108 211/132.1
2,964,195 A 12/1960 Henrietta
3,161,298 A * 12/1964 Naslund ..... A47B 43/00 211/104
4,022,325 A 5/1977 Barrett
4,150,682 A * 4/1979 Ryce ..... E04H 15/52 135/120.1
4,817,792 A * 4/1989 Seifert ..... G11B 33/0438 206/307.1
5,746,237 A * 5/1998 Arnic ..... E04H 6/04 135/133
5,830,089 A * 11/1998 Halter ..... A63B 63/004 273/400
6,065,610 A 5/2000 Elmore
6,763,842 B2 * 7/2004 Blount ..... E04H 6/04 135/131
7,510,089 B2 3/2009 Killinger
9,745,080 B2 * 8/2017 Gutkuhn ..... B64F 1/305
2006/0157100 A1 * 7/2006 Zeigler ..... B65G 13/12 135/145
2017/0138005 A1 * 5/2017 Trewern ..... E01F 13/022

* cited by examiner

*Primary Examiner* — Ko Hung Chan
(74) *Attorney, Agent, or Firm* — The Law Office of Scot S. Fagerland

(57) ABSTRACT

This invention is a fully collapsible file holder, or collator. It is formed from an assembly of supports. When opened, the supports are separated by about an inch, allowing papers, files, and books to be organized between them. When the collator is not in use, it collapses to the thickness of a fraction of an inch. This is facilitated by the invention's novel design, wherein the supports decrease in size from rear to front. When collapsed, they nest inside one another. The full range of movement is enabled by a novel hinge, formed of two struts in a scissors configuration. The collator folds flat to become so small that it is easily transportable in a satchel or even a notebook. This offers great advantage over the very bulky collators in use today.

15 Claims, 7 Drawing Sheets

COLLATOR

1. FIELD OF THE INVENTION

This invention is in the field of racks, and in particular desk files.

2. BACKGROUND OF THE INVENTION

A collator is a lightweight desktop structure for holding paper files. Current collators have roughly two to twelve rigid supports about the size of a piece of paper. The supports are plastic or metal solid sheets, or loops like inverted U's. Consecutive supports are separated by about a half-inch in order to accommodate many papers between them. Each support is connected firmly to a bottom rail on each side to hold the product together.

The problem with the current design is that it is bulky. Some collators are not collapsible at all, while others are only partly collapsible. Even in the collapsed configuration, they are several inches thick. Collators are used regularly in environments such as elections, conferences, and film shoots, where facilities are only temporary. In this setting, it is desirable to pack up the collator and carry it from one location to another. Though a collator is not heavy like furniture, it is still too bulky to carry in a briefcase, tote bag, or backpack.

3. DESCRIPTION OF RELATED TECHNOLOGY

A product by Lee connects consecutive, equally-sized supports with an accordion hinge. When the product is collapsed, the supports are pressed together, closing the gap between them. Collapsing makes the product smaller by about half. However, Lee added more dividers in the half-inch gaps, allowing the product to open to twice as many dividers while taking up the same amount of room. At best, this product collapses to the thickness of the supports on the support frame (roughly ¼-½ inch) multiplied by the number of supports. For a rack with 12 supports, this results in a thickness of six inches even when the rack is collapsed.

Red Dot has a product that collapses. Using the same formula, the result is a much flatter product when it's in a collapsed position. The dividers are thin, clear, plastic sleeves to fit papers or folders. A fabric instead of a solid hinge connects each sleeve. There are no rigid parts to give the item overall structural integrity; it cannot stand on its own. The product hangs on a hook from a door. Each sleeve cascades down the door tethered at the top and bottom to the sleeve above and below. It is not designed as a desktop item.

What is desired is an expanding collator that is both rigid and fully collapsible.

4. SUMMARY OF THE INVENTION

The present invention is a collator that is both rigid and fully collapsible. It is free-standing, portable, storable, and stowable (like an airplane tray table).

This collator is made from a plurality of vertical supports. The entire structure collapses to the thickness of just one support (roughly ¼ inch in its preferred embodiment). The front-most support is the shortest vertically and the narrowest in the left-right direction. Successive supports are progressively taller vertically and wider in the left-right direction. When the collator is collapsed, each smaller support nests entirely inside the next larger support. This is a flattened variation of a periscope or old radio antenna.

Unique hinges on each side of the supports allow the structure to collapse or expand. Each hinge has two struts that connect two consecutive supports. In the preferred embodiment, the two struts cross in an "X" configuration when the collator is expanded. In the prior art, accordion hinges were limited in their capacity to fully close, because the struts made contact with each other. The thicker the struts, the less fully the hinge could close. In the present invention, the struts are designed to bypass one another so that they may line up almost vertically when the hinge is closed. This allows for a very tight collapse.

The rearmost support has holes in the rear so the collator can be mounted to a wall.

5. BRIEF DESCRIPTION OF THE DRAWINGS

6. DETAILED DESCRIPTION OF THE PREFERRED EMBODIMENTS

Figure 1:
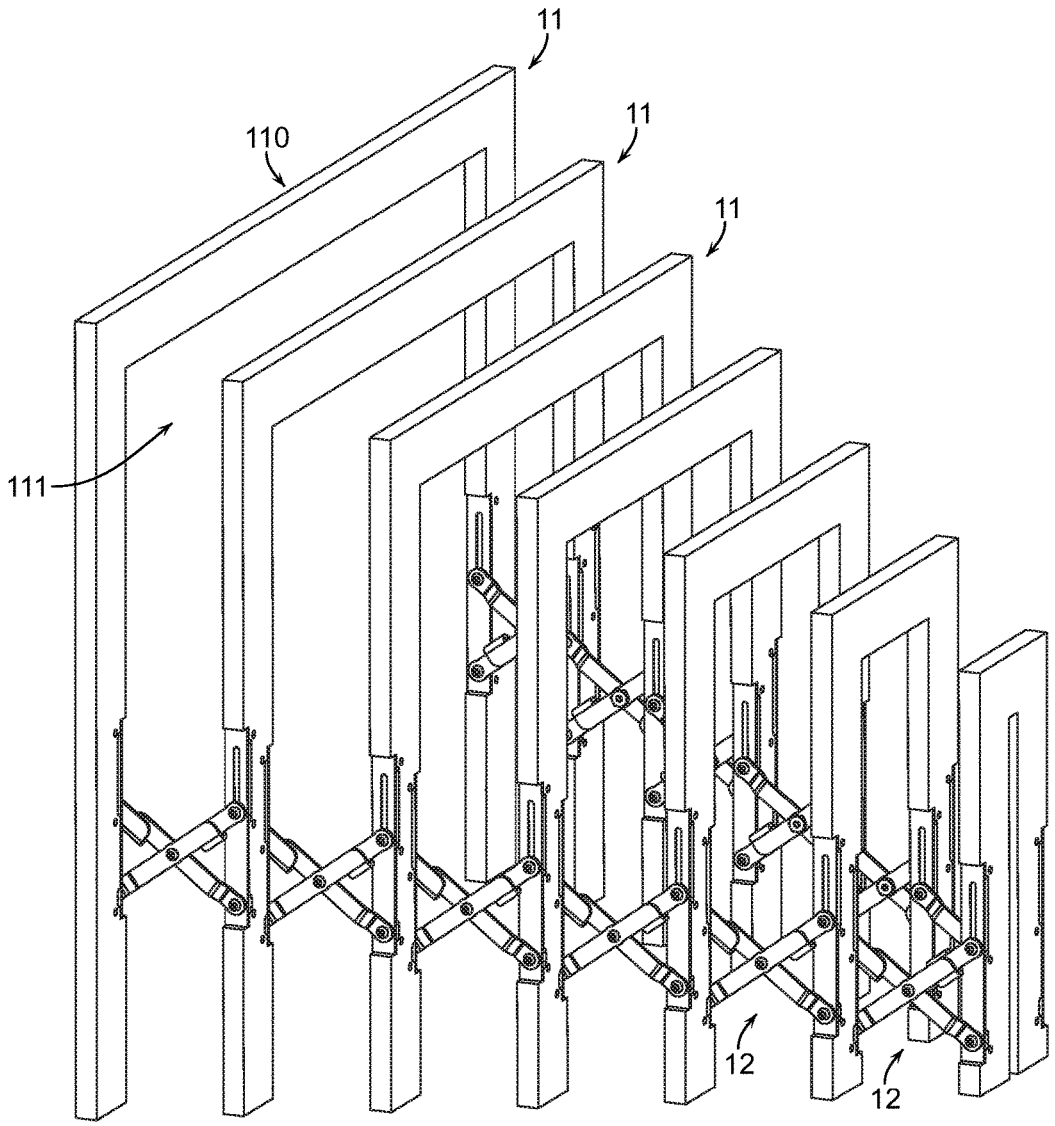
FIG. 1 shows a perspective view of the collator in expanded configuration.

FIG. 1 shows a perspective view of the collator in expanded configuration. The collator comprises a plurality of vertical supports 11. Each support has a frame 110 made of a rigid material such as plastic or metal. Within the plane of the frame, the support has an opening 111.

Each part of this invention has three dimensions of height, width, and thickness. The height is vertical, i.e. as measured vertically from a tabletop. The front-rear axis runs through the collator orthogonally to the planes of the supports. "Thickness" describes measurements in the front-rear direction. The third dimension defines the left-right sides of the product, and "width" describes measurements in the left-right direction.

The front-most support is the smallest, both in height and width. Progressively to the rear, each support is larger than the one in front of it, both in height and width. More precisely, the opening of each support is both taller and wider than the frame of the support immediately to its front.

Hinges 12 connect the supports together. Each hinge is attached to two supports, one to its front and one to its rear. Except for the front-most and rear-most support, each support is attached to four hinges, two on its right side and two on its left side. The front-most and rear-most supports are each attached to two hinges, one on the right and one on the left.

When the collator is in active use, it is in expanded position as shown in FIG. 1. The hinges are open, and the supports are separated from one another, with empty space between each pair of consecutive supports. This empty space is useful for storing papers, books, file folders, etc.

Figure 2:
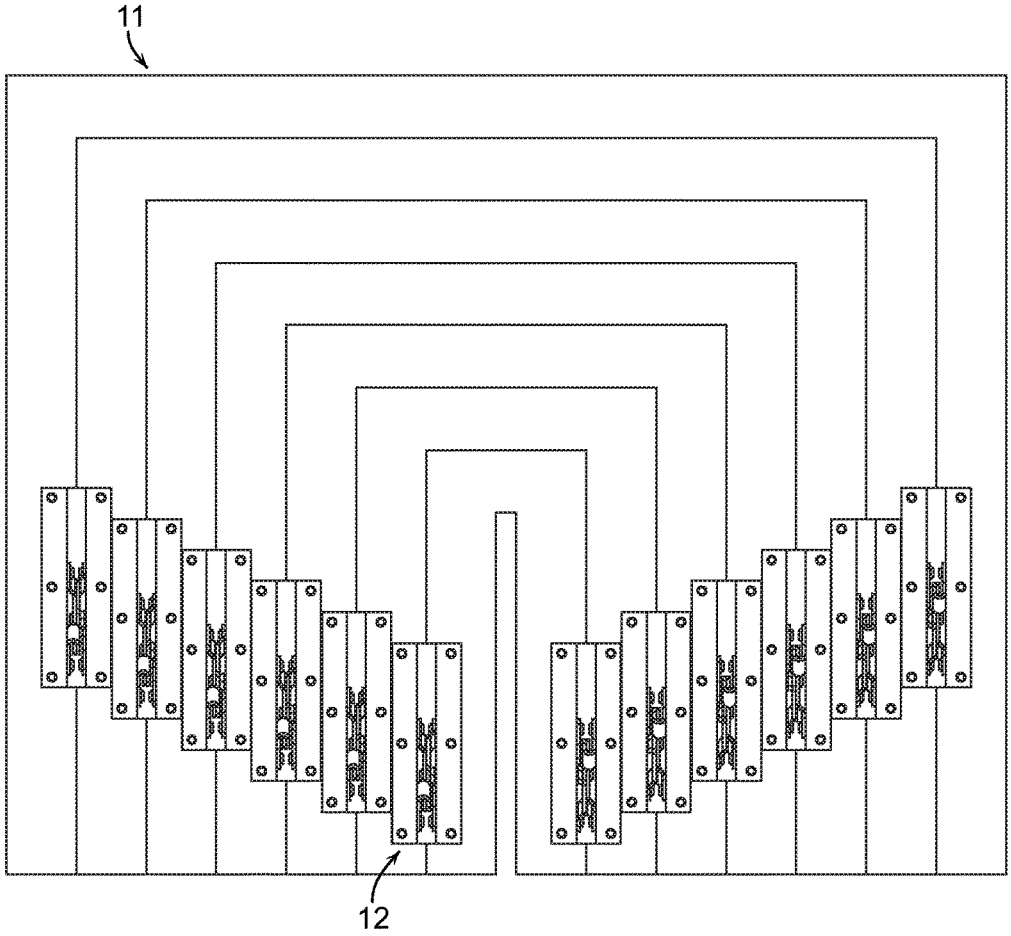
FIG. 2 is a front plan view of the collator in collapsed configuration.

When the collator is in storage, it is in collapsed position as shown in FIG. 2. The hinges 12 are closed, and the supports 11 are nested inside each other, all within the same plane. The entire collator now has the thickness of approximately one support. This full collapsibility and nesting feature is the main point of novelty of this invention.

Minimizing the thickness of the collapsed collator requires not just the nested supports but also a specialized hinge. The hinges must collapse as flatly as possible so that they can allow the supports to nest within the same plane. Traditional "accordion" hinges cannot close completely, because the struts run up against each other.

Figure 3:
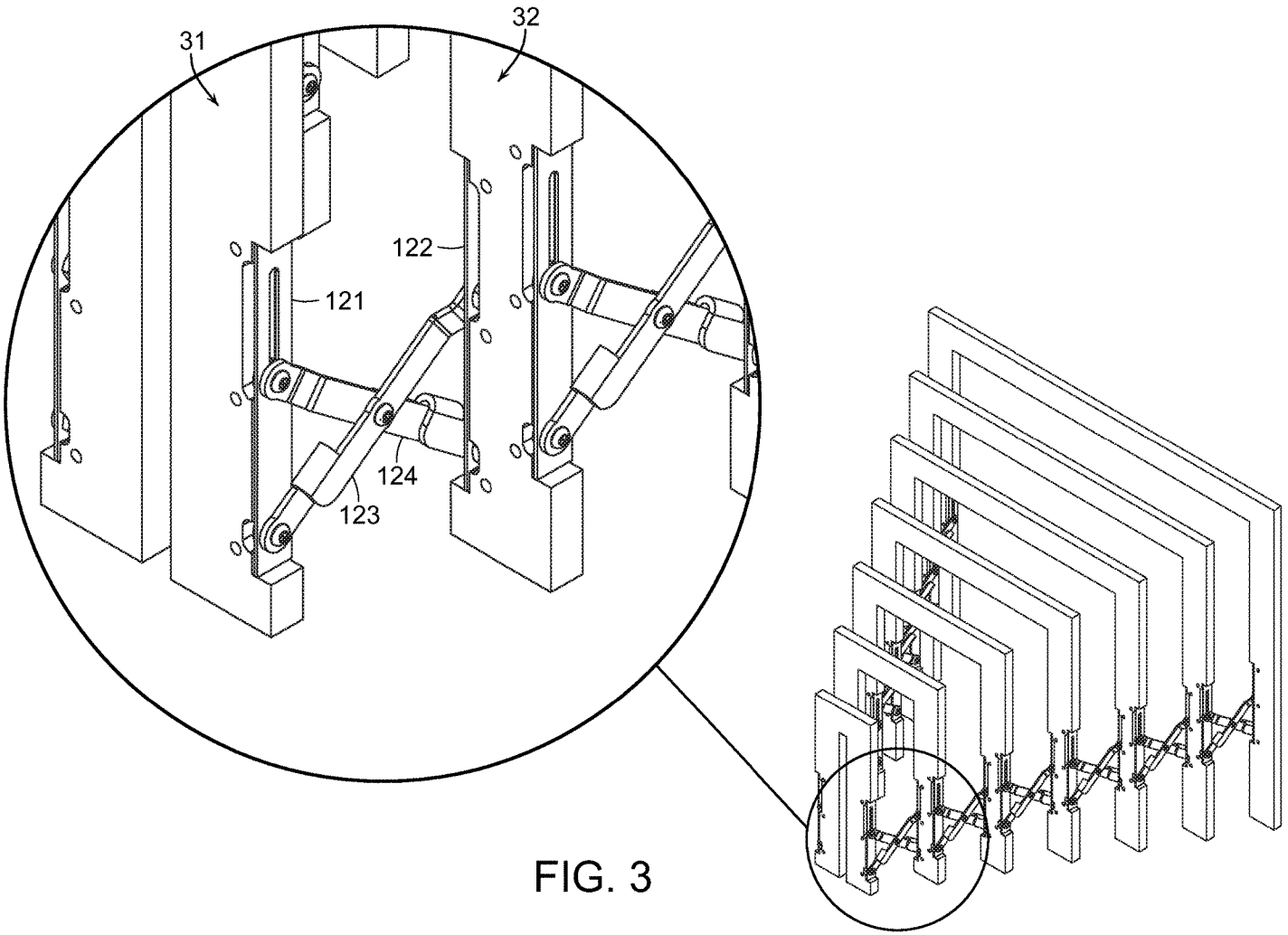
FIG. 3 shows the preferred embodiment of a right hinge within the collator, in the fully expanded position.
Figure 5:
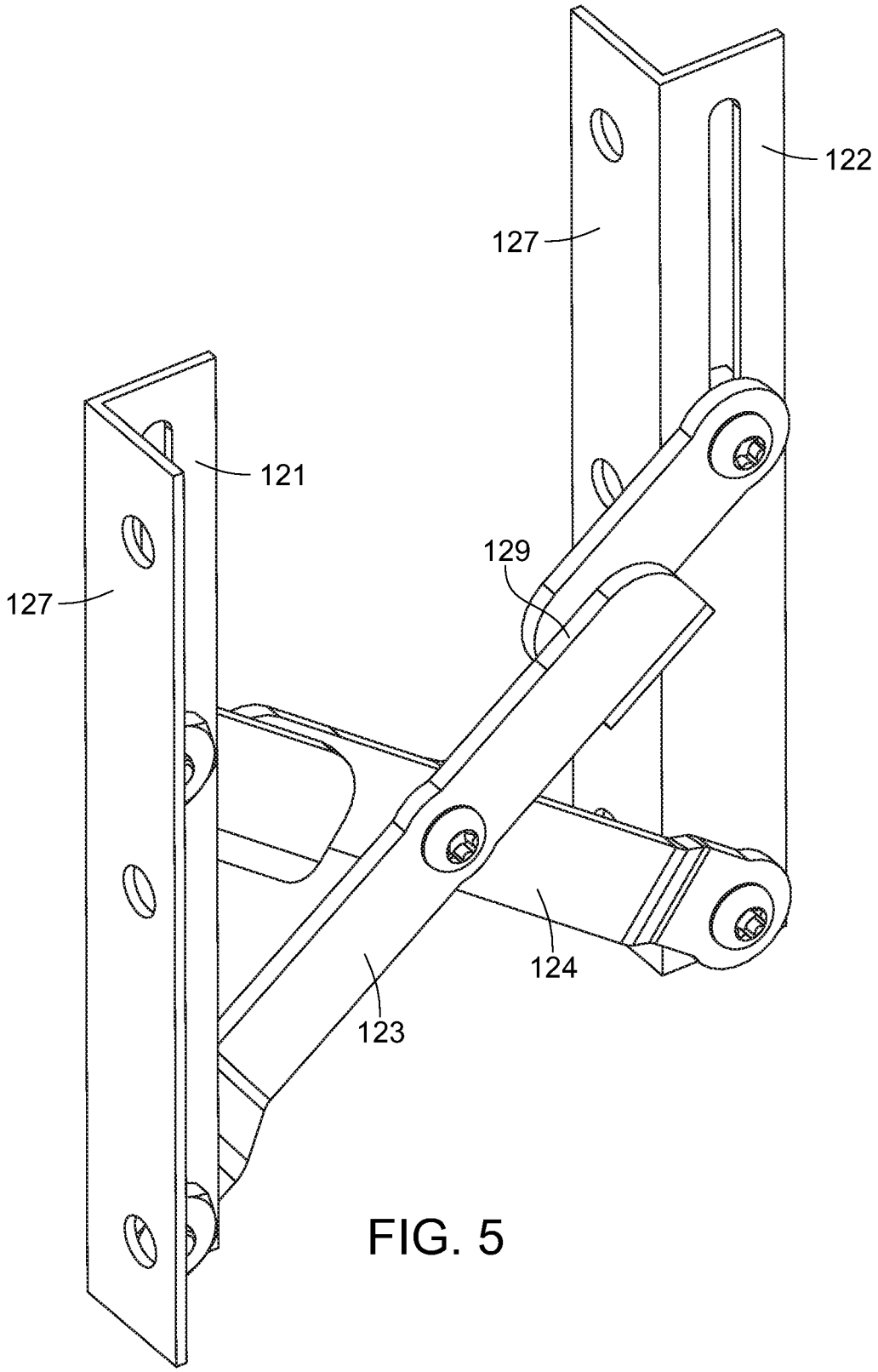
FIG. 5 is a first perspective view of a left hinge in an open position.
Figure 6:
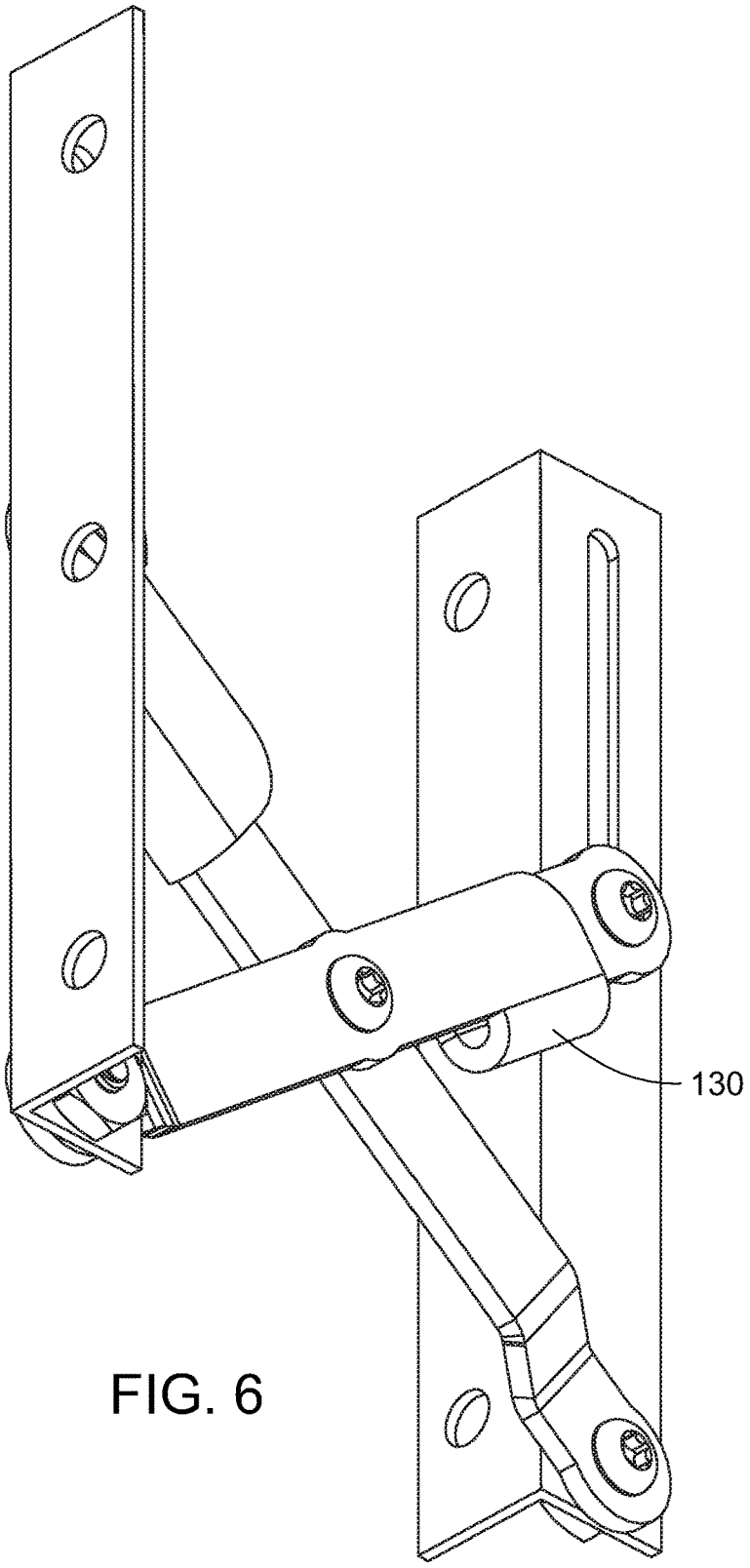
FIG. 6 is a second perspective view of a left hinge in an open position.
Figure 7:
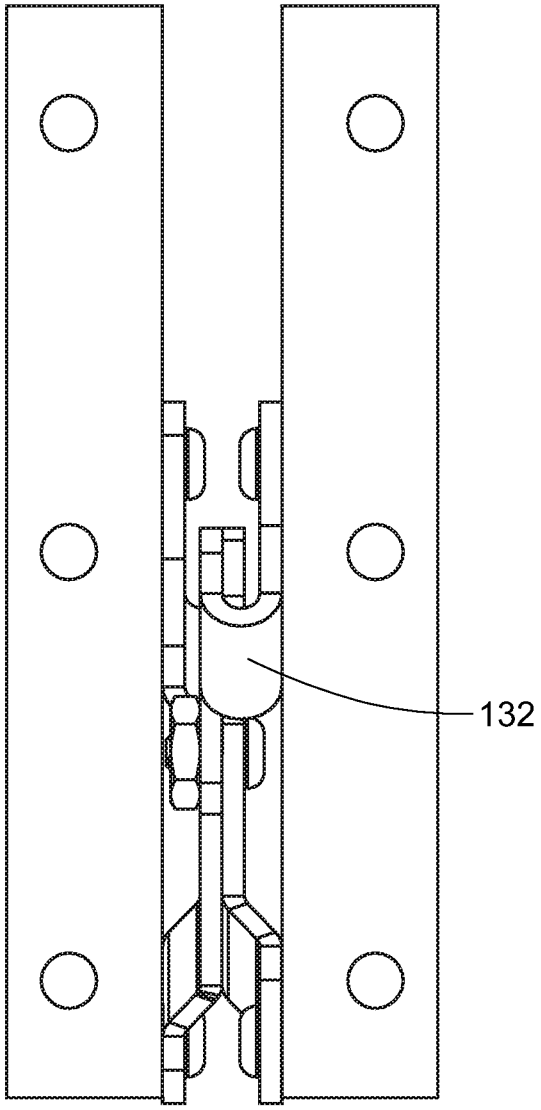
FIG. 7 depicts a hinge in closed position.

FIG. 3 shows the preferred embodiment of a hinge 12 on the right side of the collator. A left hinge is shown in isolation in FIGS. 4-6. Right hinges and left hinges are mirror images of each other.

The hinge comprises a front bracket 121 attached to a front support 31, a rear bracket 122 attached to a rear support 32, a first strut 123, and a second strut 124. Each bracket has a flanged rim 127 at a right angle to the main bracket. Each support fits within the right angle formed by a bracket and its flanged rim.

When the hinge is in the expanded position, the first strut 123 and the second strut 124 cross each other in an "X" configuration. The first strut and second strut are connected centrally by a bushing 125; both struts pivot about the bushing.

Figure 4:
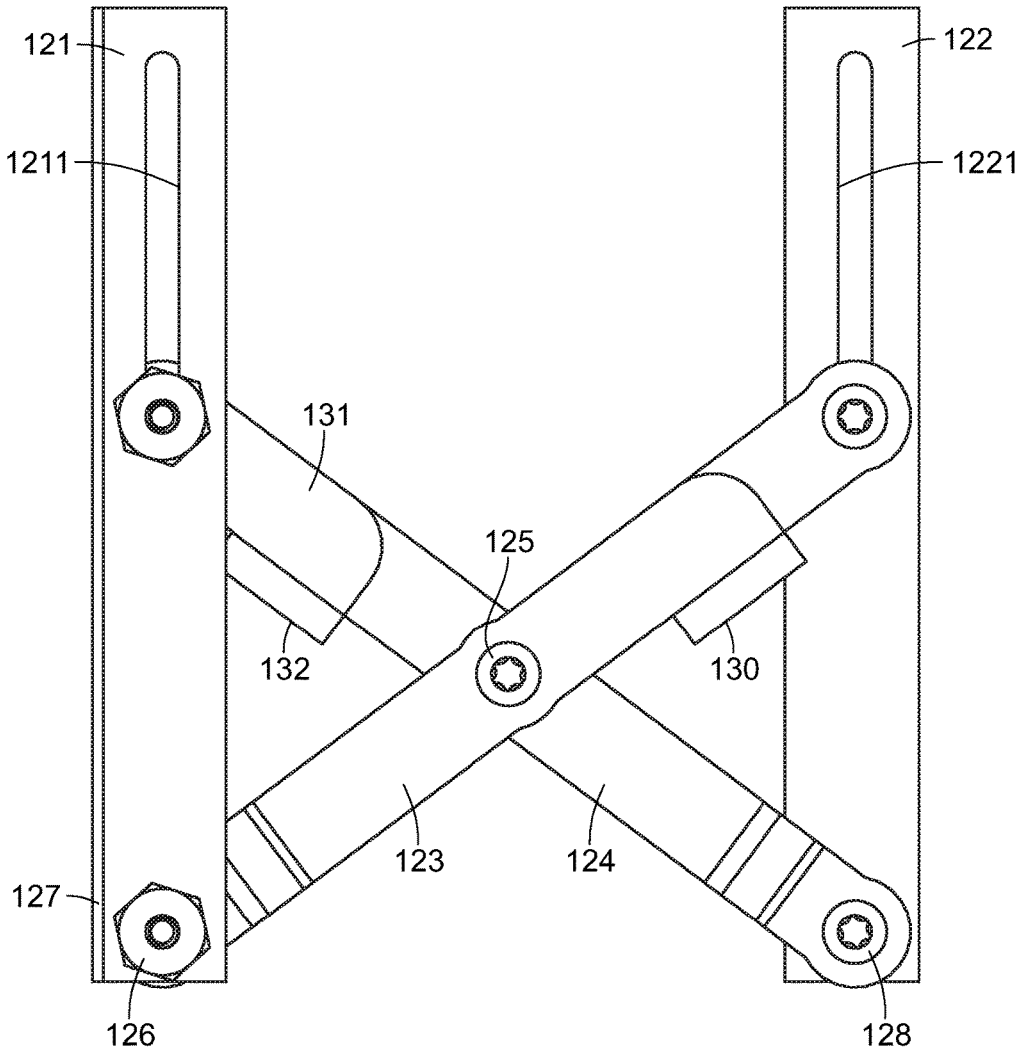
FIG. 4 is a right-plan view of the preferred embodiment of a left hinge in isolation, in a partly expanded position.

The first strut 123 is fixedly attached to the outer side of the front bracket, near the bottom of the front bracket. This attachment is secured with rivet 126 (FIG. 4). The second strut is movably attached to the outer side of the front bracket, above the point of attachment of the first strut. A groove 1211 in the front bracket accommodates the vertical motion of the second strut as the hinge opens and closes. See FIG. 4.

In like manner, the second strut 124 is fixedly attached to the inner side of the rear bracket 32, near the bottom of the rear bracket. This attachment is secured with rivet 128. The first strut 123 is movably attached to the inner side of the rear bracket, above the point of attachment of the second strut. A groove 1221 in the rear bracket (see FIG. 4) accommodates the vertical motion of the first strut as the hinge opens and closes.

As the hinge is closed, the struts move toward each other. In a normal accordion-file rack, the struts abut against one another, preventing the rack from folding into a completely closed position. The present invention features a "parallel hinge", similar in structure to a pair of scissors. The struts are not coplanar with one another, but closely parallel. The first strut is offset slightly inward, toward the center of the rack, from the second strut. This allows the struts to close to a completely vertical configuration. The front bracket is offset inward, toward the center of the rack, from the rear bracket. When the hinge is closed, the front bracket pulls up alongside the rear bracket, nested inside of the rear bracket. Because this happens simultaneously for all pairs of adjacent brackets, all the brackets line up in the same plane, and the rack collapses completely flat.

If the hinges were completely unrestricted, they could rotate beyond closure, thus reopening the rack in the rearward direction. In an optional embodiment, this is prevented with a pair of catches. The first catch 129 is a fold in the first strut, open in the front and with a first stop 130 at the rear. When the hinge is closed to a vertical position, the second strut 124 fits inside the first catch 129, and then abuts the first stop 130, which restricts the struts from further movement. A second catch 131 is a fold in the second strut, open in the rear and with a second stop 132 in the front. When the hinge is closed to a vertical position, the first strut 123 fits inside the second catch 131, and then abuts the second stop 132, which restricts the struts from further movement.

When the collator is in expanded position, the hinges also act as the rests upon which the files sit. In one embodiment of the invention, the hinges are all attached to the bottom of the supports. When they are expanded, they lie flat essentially at the level of the tabletop. In an alternative embodiment, the hinges are arranged "stadium style", with each hinge slightly higher than the hinge in front of it (See FIGS. 1-3). The stadium style arrangement allows for easier visibility of files toward the rear of the collator.

I claim:

1. A collator, comprising a plurality of supports of increasing size, each support comprising a rigid frame and an opening within the frame;

each frame comprising a top side, a left side, a right side, a front face, and a rear face;

whereas, in a flattened position, the frame of each support fits within the opening of each larger support and all supports are coplanar to each other in the flattened position;

hinges for connecting adjacent supports to one another;

whereas, in an expanded position, the supports are separated from one another along the front-rear axis;

wherein each frame assumes the shape of the top, left, and right sides of a rectangle;

and wherein each hinge connects a pair of consecutive supports;

one hinge connects the right side of each support, except the largest support, to the right side of the next larger support;

one hinge connects the right side of each support, except the smallest support, to the right side of the next smaller support;

one hinge connects the left side of each support, except the largest support, to the left side of the next larger support;

one hinge connects the left side of each support, except the smallest support, to the left side of the next smaller support;

and wherein each hinge comprises a front bracket attached to the smaller support;

a rear bracket attached to the larger support;

a first strut, fixedly attached to the smaller support at a lower height, and movably attached to the larger support at a higher height;

a second strut, fixedly attached to the larger support at a lower height, movably attached to the smaller support at a lower height, and attached to the first strut at an intermediate height.

2. The collator of claim 1, wherein the first strut of each right hinge is offset to the left of the second strut of the same hinge;

the first strut of each left hinge is offset to the right of the second strut of the same hinge.

3. The collator of claim 2, also comprising a fold in each first strut;

a fold in each second strut;

so that, in the flattened position, each first strut fits in the fold of the second strut of the same hinge, and each second strut fits in the fold of the first strut of the same hinge.

4. The collator of claim 1, wherein all hinges are attached at the lower ends of the supports.

5. The collator of claim 1, wherein the hinges attached to each support, except the smallest support, are attached to the support in a higher position than the hinges of the next smaller support.

6. The collator of claim 2, wherein all hinges are attached at the lower ends of the supports.

7. The collator of claim 2, wherein the hinges attached to each support, except the smallest support, are attached to the support in a higher position than the hinges of the next smaller support.

8. The collator of claim 3, wherein all hinges are attached at the lower ends of the supports.

9. A collator, comprising a plurality of supports of increasing size, each support comprising a rigid frame and an opening within the frame;

each frame comprising a top side, a left side, a right side, a front face, and a rear face;

whereas, in a flattened position, the frame of each support fits within the opening of each larger support, and in which all supports are coplanar;

hinges for connecting adjacent supports to one another;

whereas, in an expanded position, the supports are separated from one another along the front-rear axis;

and wherein each hinge connects a pair of consecutive supports;

one hinge connects the right side of each support, except the largest support, to the right side of the next larger support;

one hinge connects the right side of each support, except the smallest support, to the right side of the next smaller support;

one hinge connects the left side of each support, except the largest support, to the left side of the next larger support;

one hinge connects the left side of each support, except the smallest support, to the left side of the next smaller support;

and wherein each hinge comprises a first strut, fixedly attached to the smaller support and movably attached to the larger support;

a second strut, fixedly attached to the larger support, movably attached to the smaller support, and attached to the first strut.

10. The collator of claim 9, wherein the first strut is fixedly attached to the smaller support at a lower height and movably attached to the larger support at a higher height;

the second strut is fixedly attached to the larger support at a lower height, movably attached to the smaller support at a lower height, and attached to the first strut at an intermediate height.

11. The collator of claim 9, wherein each hinge further comprises a front bracket attached to the smaller support and a rear bracket attached to the larger support.

12. The collator of claim 10, wherein each hinge further comprises a front bracket attached to the smaller support and a rear bracket attached to the larger support.

13. The collator of claim 9, wherein each frame assumes the shape of the top, left, and right sides of a rectangle.

14. The collator of claim 13, wherein the first strut is fixedly attached to the smaller support at a lower height and movably attached to the larger support at a higher height;

the second strut is fixedly attached to the larger support at a lower height, movably attached to the smaller support at a lower height, and attached to the first strut at an intermediate height.

15. The collator of claim 13, wherein each hinge further comprises a front bracket attached to the smaller support and a rear bracket attached to the larger support.

* * * * *